US012251601B2

(12) United States Patent
Gutierrez

(10) Patent No.: US 12,251,601 B2
(45) Date of Patent: Mar. 18, 2025

(54) PORTABLE CALF BUILDING MACHINE

(71) Applicant: Jesus Gutierrez, Colorado Springs, CO (US)

(72) Inventor: Jesus Gutierrez, Colorado Springs, CO (US)

( * ) Notice: Subject to any disclaimer, the term of this patent is extended or adjusted under 35 U.S.C. 154(b) by 91 days.

(21) Appl. No.: 18/118,278

(22) Filed: Mar. 7, 2023

(65) Prior Publication Data

US 2024/0299802 A1 Sep. 12, 2024

(51) Int. Cl.

| | |
|---|---|
| ***A63B 23/08*** | (2006.01) |
| ***A63B 21/00*** | (2006.01) |
| ***A63B 21/02*** | (2006.01) |
| ***A63B 21/04*** | (2006.01) |
| ***A63B 23/035*** | (2006.01) |

(52) U.S. Cl.

CPC ..... *A63B 23/08* (2013.01); *A63B 21/00069* (2013.01); *A63B 21/023* (2013.01); *A63B 21/0421* (2013.01); *A63B 21/4034* (2015.10); *A63B 21/4047* (2015.10); *A63B 23/03508* (2013.01)

(58) Field of Classification Search

CPC . A63B 23/08; A63B 21/00069; A63B 21/023; A63B 21/0421; A63B 21/4034; A63B 21/4047; A63B 23/03508

See application file for complete search history.

(56) References Cited

U.S. PATENT DOCUMENTS

| | | | | |
|---|---|---|---|---|
| 3,295,847 | A * | 1/1967 | Matt, Sr. | A63B 22/16 482/80 |
| 3,687,458 | A * | 8/1972 | Proctor, Jr. | A63B 69/3632 473/204 |
| 4,111,416 | A * | 9/1978 | Jinotti | A63B 21/1672 482/80 |
| 4,279,415 | A * | 7/1981 | Katz | A63B 69/0035 482/80 |
| 5,352,173 | A * | 10/1994 | McLaughlin | A63B 23/03575 482/121 |
| 5,441,466 | A * | 8/1995 | Piaget | A63B 21/0085 297/DIG. 8 |
| D383,813 | S * | 9/1997 | Zoller | D21/685 |
| 6,976,939 | B2 * | 12/2005 | Harker | A63B 22/205 482/52 |
| 8,029,420 | B1 * | 10/2011 | Thati | A63B 22/0056 482/79 |
| 8,360,940 | B2 * | 1/2013 | Kole | A63B 21/0552 482/79 |
| 9,302,153 | B2 * | 4/2016 | Harwin | A63B 21/068 |
| 10,434,357 | B2 * | 10/2019 | McCarthy | A63B 21/0552 |
| 10,772,783 | B2 * | 9/2020 | Dunca | A63B 21/4034 |

(Continued)

FOREIGN PATENT DOCUMENTS

WO WO-2006118377 A1 * 11/2006 ..... A61H 39/04

*Primary Examiner* — Andrew S Lo

(74) *Attorney, Agent, or Firm* — Lyman Moulton, Esq.; Moulton Patents, PLLC

(57) ABSTRACT

An exercise apparatus is disclosed which provides a fully operational calf building machine that can be used in diverse settings as one watches TV at home, while doing the dishes, or even while working at an office, for example. As a result, the Portable Calf Machine may benefit all individuals who seek to have a more convenient and efficient means of building their calves, at their leisure.

12 Claims, 4 Drawing Sheets

(56) References Cited

U.S. PATENT DOCUMENTS

| | | | | |
|---|---|---|---|---|
| 11,638,852 | B2 * | 5/2023 | Tarkington ..... | A63B 21/4047<br>482/80 |
| 2007/0219071 | A1 * | 9/2007 | Hamer ..... | A63B 21/4015<br>482/79 |

* cited by examiner

PORTABLE CALF BUILDING MACHINE

BACKGROUND

When it comes to physical fitness, it is commonly known that one of the most stubborn parts of the body to build are the calves. To effectively target calf muscles a person must rely on special equipment and ensure proper form while engaging in a wide variety of specific exercises that may be difficult to perform, especially, when formal gym access is not available. There have been no products available as original equipment or as an aftermarket to address this problem.

An apparatus that when exercising effectively targets the calf muscles is not being met by any known device or system at present. There have been no products available as original equipment or as an aftermarket to address this problem either.

SUMMARY OF THE INVENTION

The main purpose of the tree ladder is to provide users with a method of training and building their calves via a compact equipment option suitable for use at any time and in any location.

Figure 1:
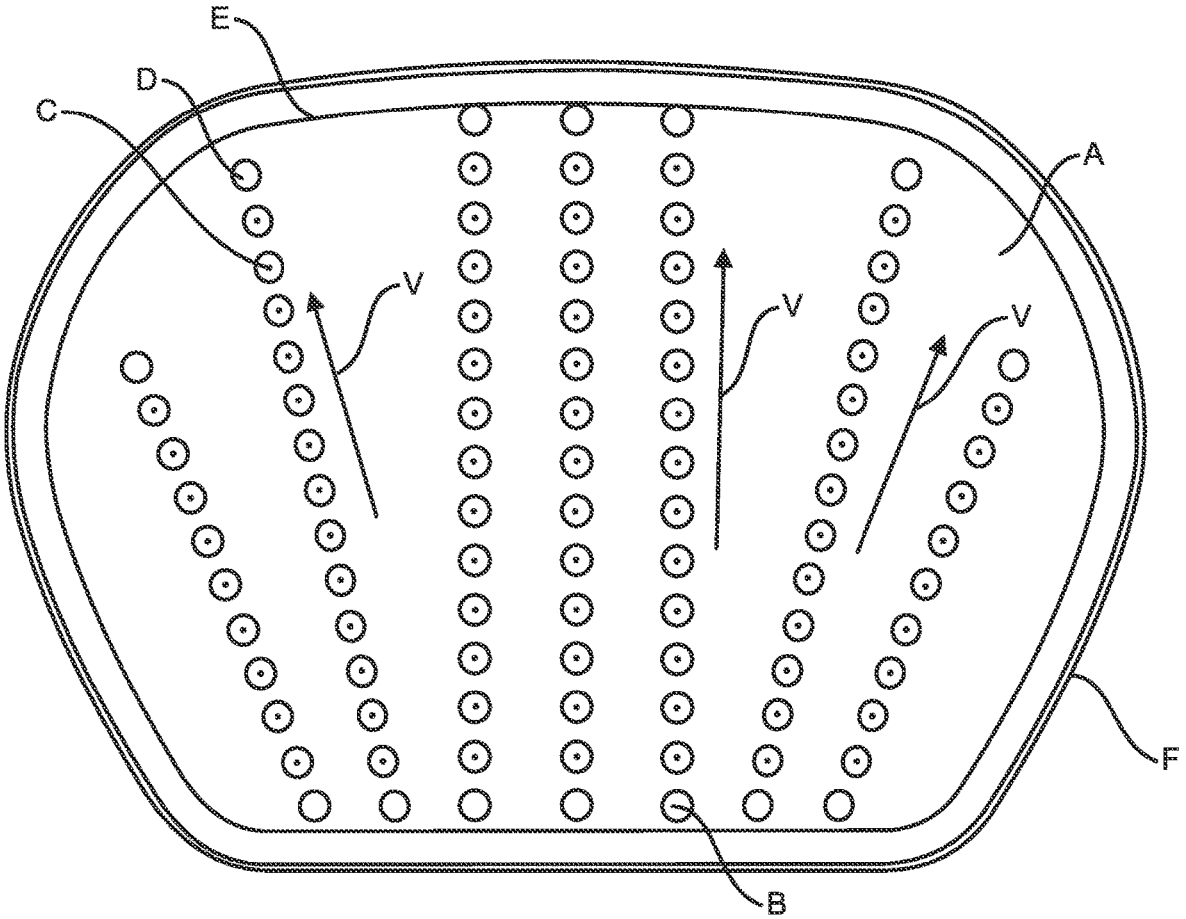
FIG. 1 is a top elevational view of the tree ladder's ground plate-bottom layer, in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a top elevational view of the tree ladder's ground plate-bottom layer showing: angle adjustment track referenced as A, graduated springs with graduated number of coils including short coils referenced as B, 15 skinny medium length coils referenced as C, medium thickness long coils referenced as D, thick metal plate referenced as E, hard plastic outer chassis referenced as F, in accordance with an embodiment of the present disclosure. The disclosed graduated springs with graduated number of coils comprise a difference in displacement and therefore difference in force exerted to the user in an exercise use of the disclosure. The angle adjustment track shown in other figures herein fixes the displacement of the respective springs and therefore fixes both the amount of displacement (maximum and minimum) of the graduated springs and a tension needed from the user to overcome the spring constant and cause the displacement. A tightening of the locking adjustment knob H increases the tension needed to overcome the spring constant and effect a displacement and sets a maximum displacement on locking. The vector force lines V show the lines of force exerted on the foot plate by an operator stepping on the foot plate.

Figure 2:
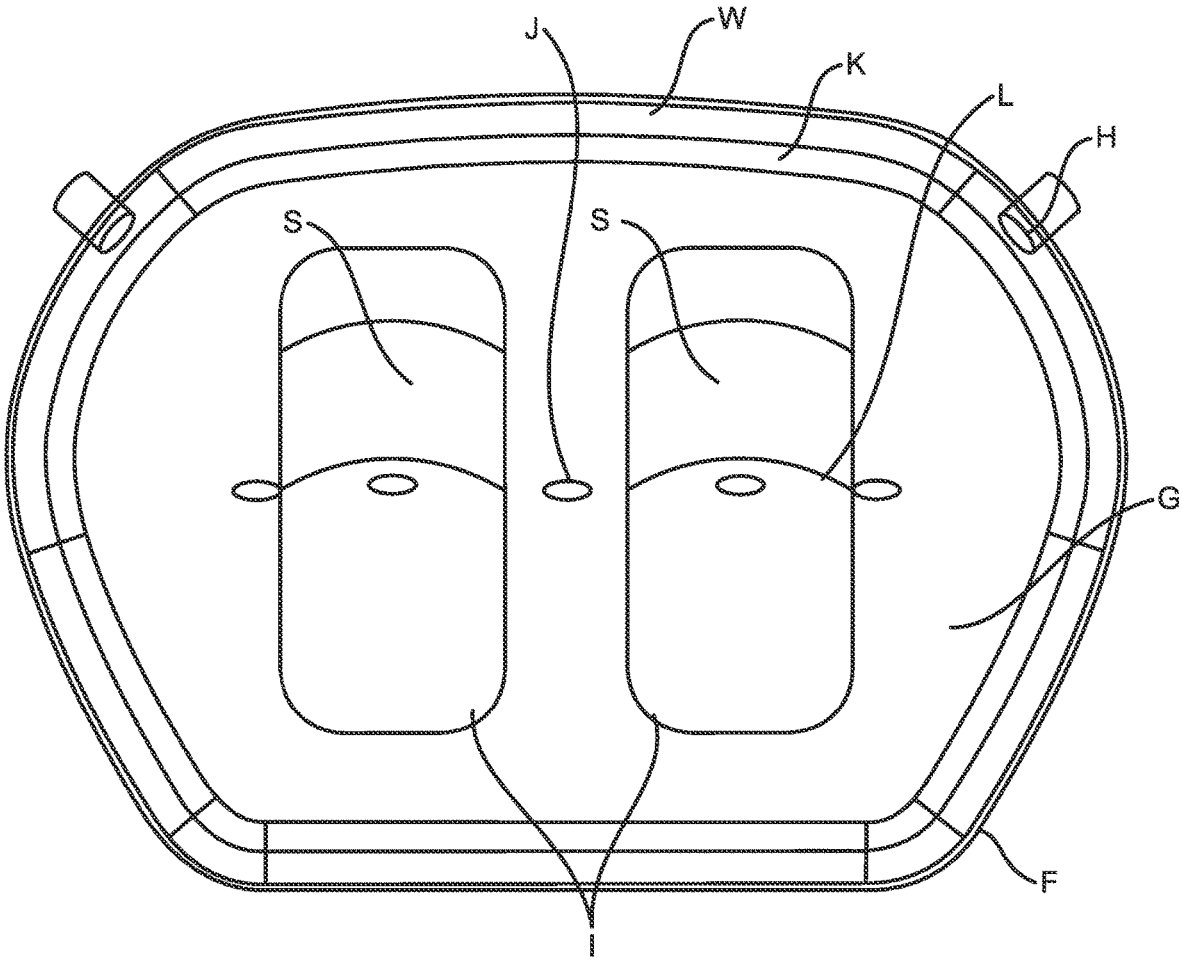
FIG. 2. is a top elevational view of the tree ladder's foot plate-top layer, in accordance with an embodiment of the present disclosure.

FIG. 2. is a top elevational view of the tree ladder's foot plate-top layer showing: hard plastic outer chassis referenced as F, foot plate for angle adjustment connected to springs and coils referenced as G, locking adjustment knob H connected to lever M, foot placement with straps referenced as I, left/center/right angled lock referenced as J, metal lip referenced as K, locking key slots referenced as L, in accordance with an embodiment of the present disclosure. The foot straps S are adjustable to varying foot widths, shapes and sizes. The bellows spacer W spans the operating distance between the foot plate G and the chassis F.

Figure 3:
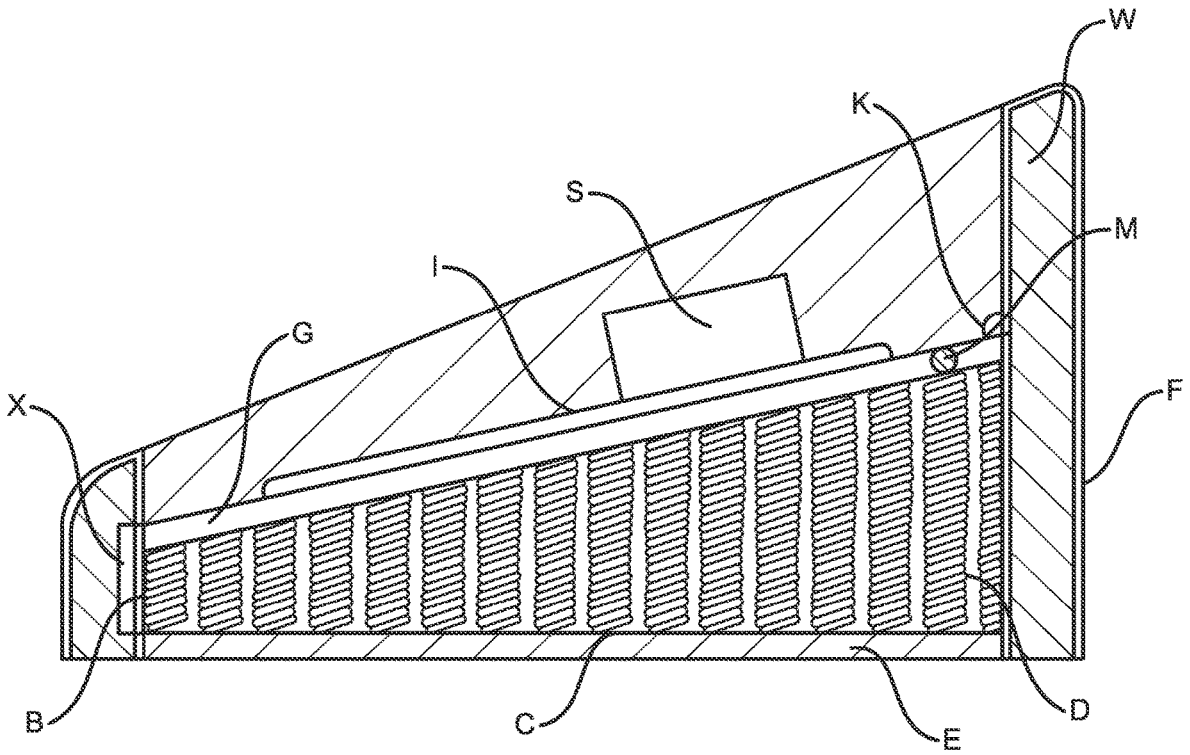
FIG. 3. is a side elevational view of the tree ladder's section, in accordance with an embodiment of the present disclosure.

FIG. 3. is a side elevational view of the tree ladder's section showing: short coils referenced as B, 15 skinny medium length coils referenced as C, medium thickness long coils referenced as D, thick metal plate referenced as E, hard plastic outer chassis referenced as F, foot plate for angle adjustment connected to springs and coils referenced as G, foot placement with straps referenced as I, metal lip referenced as K, lever rod connecting foot plate with angle adjustment rod referenced as M, in accordance with an embodiment of the present disclosure. The foot straps S are adjustable to varying foot widths, shapes and sizes. Angle adjustment rod M attaches to a knob depicted as H in other figures. The angle adjustment rod and knob therefore control a depression angle and spring coil suppression according to its relation in the angle adjustment track A and accordingly varies a resistance of the graduated coils against the thick metal plate E and an exercise intensity resulting therefrom. The spacer bellows W spans the operating distance between the foot plate G and the chassis F accommodating the arc of the footplate G matching the arc of the adjustment track per the hinge X.

Figure 4:
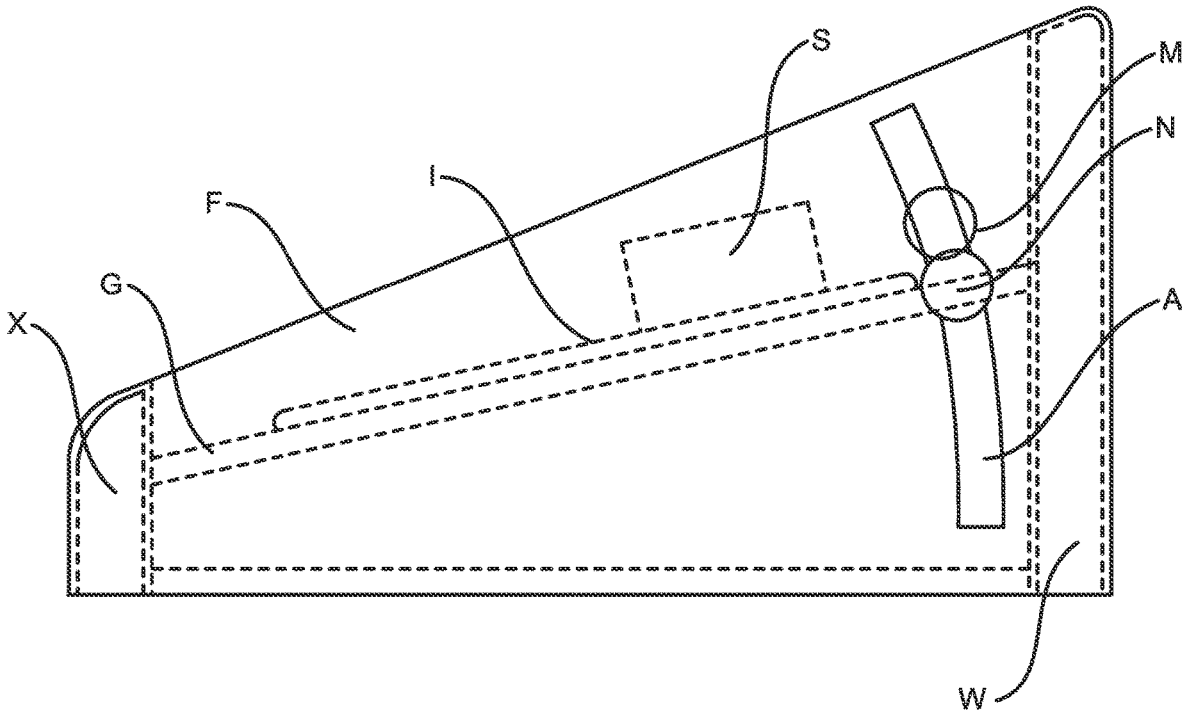
FIG. 4. is a side elevational view of the tree ladder, in accordance with an embodiment of the present disclosure.

FIG. 4. is a side elevational view of the tree ladder showing: angle adjustment track referenced as A, foot plate for angle adjustment connected to springs and coils referenced as G, locking adjustment knob H connected to lever M, foot placement with straps referenced as I, in accordance with an embodiment of the present disclosure. The outer chassis F is constructed of hard plastic and other hard and rigid materials and is roughly equivalent to a cylindrical section. The foot straps S are adjustable to varying foot widths, shapes and sizes. The spacer bellows W spans the operating distance between the foot plate G and the chassis F accommodating the arc of the footplate G matching the arc of the adjustment track per the hinge X. The locking adjustment knob H fixes the travel of the lever rod M in the angle adjustment track and therefore limits a graduated spring displacement between the base plate E and the foot plate G. The hinge X may be pinless and configured to hinge ends of the base plate E and the foot plate G connection to be proximal or distal depending on a size of the hinge.

The present disclosed tree ladder, also known as "The Portable Calf Machine", offers a modem accessory that allows users to practice targeted calf exercises in the convenience of their homes or while abroad in an office, park, or virtually anywhere they desire to maximize the development of this particular body region. The Portable Calf Machine introduces a novel training device specifically developed for the calf muscles. This unit possesses a chassis able to house a plate that is securely fitted to ensure it does not shift while the user is operating the machine. In order for it to work efficiently, the user will strap their feet to a thirds upper foot plate capable of moving right, left and center with the provided locking key mechanisms. Furthermore, users will be able to adjust the pressure by using a locking lever connected to the metal angle plate, measuring about half an inch long, which runs seventy five percent off the front of the first plate. The lever allows users to start at forty-five degrees up to seventy degrees for a more strenuous angle whereas, at the maxed angle, users will be able to push down to approximately five degrees during engagement.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. An exercise device comprising:

a base plate and a foot plate connected by a hinge on a respective end of the base plate and the foot plate, each of the base plate and foot plate having lateral sides, an outside surface and a shared inside surface;

a chassis configured to receive the base plate and the foot plate and to define an angle adjustment track resembling an arc for a control of a movement of the foot plate relative to the base plate in the chassis;

a plurality of graduated springs comprising a common displacement length between the base plate and the foot plate; and an adjustment knob configured to fix a lever rod received in the adjustment track and set a maximum displacement length of the graduated springs.

2. The exercise device of claim 1, further comprising a variable strap configured on an outside surface of the foot plate and configured to receive an operator's feet.

3. The exercise device of claim 1, wherein the lever rod is attached to a lateral side of the foot plate and configured to travel inside the adjustment track.

4. The exercise device of claim 1, wherein the lever rod is attached to each lateral side of the foot plate and configured to travel inside a respective adjustment track in the chassis.

5. The exercise device of claim 1, wherein the adjustment knob is configured to set a maximum travel of the lever rod in the adjustment track.

6. The exercise device of claim 1, further comprising a pinless hinge configured to hinge the base plate and the foot plate at the respective ends.

7. The exercise device of claim 1, wherein the outside surface of the foot plate comprises a lip around a perimeter configured to receive an operator's feet.

8. The exercise device of claim 1, wherein the outside surface of the foot plate comprises a plurality of locking key slots to receive an operator's feet.

9. The exercise device of claim 1, wherein the common displacement length is generated by a ratio of the number of graduated springs to an inside surface distance of each respective graduated springs from the hinge.

10. The exercise device of claim 1, wherein each graduated spring has a fixed relation to the shared inside surface of the base plate and the foot plate.

11. The exercise device of claim 1, further comprising a bellows spacer between the chassis and an end perimeter of the foot plate opposite the hinge.

12. The exercise device of claim 1, further comprising a line of vector force placement of the graduated springs relative to the shared inside surface of the foot plate and the base plate.

* * * * *